US005702140A

United States Patent [19]

Radja

[11] Patent Number: 5,702,140

[45] Date of Patent: Dec. 30, 1997

[54] CARRIER FOR HOCKEY ARTICLES AND EQUIPMENT

[76] Inventor: Thomas S. Radja, 10717 Meadow La., Palos Hills, Ill. 60465

[21] Appl. No.: 606,059

[22] Filed: Feb. 23, 1996

[51] Int. Cl.[6] ..... A45F 5/00

[52] U.S. Cl. ..... 294/146; 294/143

[58] Field of Search ..... 294/19.2, 141, 294/143, 144, 146, 159; 206/315.1, 315.9, 579; 224/919; 220/500, 527, 555; 273/57.2, 67 A

[56] References Cited

U.S. PATENT DOCUMENTS

| | | | |
|---|---|---|---|
| 892,969 | 7/1908 | Wilson . | |
| 1,621,329 | 3/1927 | Malone | 294/143 |
| 2,024,484 | 12/1935 | Smith | 294/146 |
| 2,710,983 | 6/1955 | Abrams et al. | 294/141 |
| 3,618,749 | 11/1971 | Vaccaro . | |
| 3,618,750 | 11/1971 | Reiner . | |
| 3,887,103 | 6/1975 | Spooner . | |
| 3,977,521 | 8/1976 | Murphy | 206/315.1 |
| 4,188,890 | 2/1980 | de Villers . | |
| 4,262,798 | 4/1981 | Raab . | |
| 4,344,660 | 8/1982 | Molnar et al. . | |
| 4,460,085 | 7/1984 | Jantzen . | |
| 4,506,769 | 3/1985 | Franco et al. . | |
| 4,595,226 | 6/1986 | Wessel . | |
| 4,685,559 | 8/1987 | Titus . | |
| 4,775,188 | 10/1988 | Fuchs et al. . | |
| 4,817,802 | 4/1989 | Pratt . | |
| 4,842,134 | 6/1989 | Chang | 206/315.1 |
| 4,859,084 | 8/1989 | Kaumeyer . | |
| 4,929,110 | 5/1990 | Berg et al. . | |
| 5,167,170 | 12/1992 | Croteau | 294/146 |
| 5,224,602 | 7/1993 | Bettles et al. | 294/143 |
| 5,240,156 | 8/1993 | Sicotte et al. . | |
| 5,273,298 | 12/1993 | Brown, Sr. . | |
| 5,294,005 | 3/1994 | Hedges . | |
| 5,294,163 | 3/1994 | Lang . | |
| 5,335,956 | 8/1994 | Panossian . | |
| 5,377,849 | 1/1995 | Martin . | |
| 5,421,459 | 6/1995 | Mazzotti . | |
| 5,460,363 | 10/1995 | Tomer . | |

FOREIGN PATENT DOCUMENTS

| | | | |
|---|---|---|---|
| 2018895 | 12/1991 | Canada | 206/315.1 |
| 2047017 | 1/1992 | Canada . | |

OTHER PUBLICATIONS

Photographs (labeled A through K on sheets 2–7) of a combination water bottle and (removable) hockey puck carrier sold by Inglasco. (no date).

A catalog for Inglasco showing on p. 18 a photograph of a combination water bottle and (removable) hockey puck carrier. (no date).

Two (2) photographs of a carrier invented by Applicant and used by Applicant in Apr. 1995, considered to be covered by the invention as presently claimed (photographs taken in Apr. 1996).

*Primary Examiner*—Dean Kramer

*Attorney, Agent, or Firm*—Foley & Lardner

[57] ABSTRACT

An apparatus is disclosed for carrying hockey articles and equipment. The apparatus includes a base having a plurality of compartments configured to carry hockey articles and equipment, at least one of the compartments being adapted to carry a container, at least one of the compartments being adapted to carry hockey pucks, and at least one of the compartments being adapted to carry at least one information retaining article; and a handle coupled to the base. According to alternative embodiments, the carrier includes at least one compartment having a substantially circular cross-section and at least one compartment having a substantially rectangular cross-section. The base of the carrier may also be formed of a substantially open frame.

22 Claims, 4 Drawing Sheets

FIG. 5
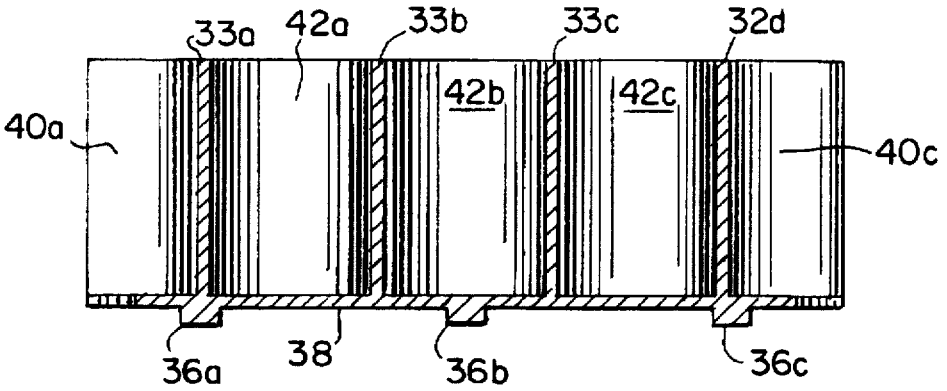
FIG. 6
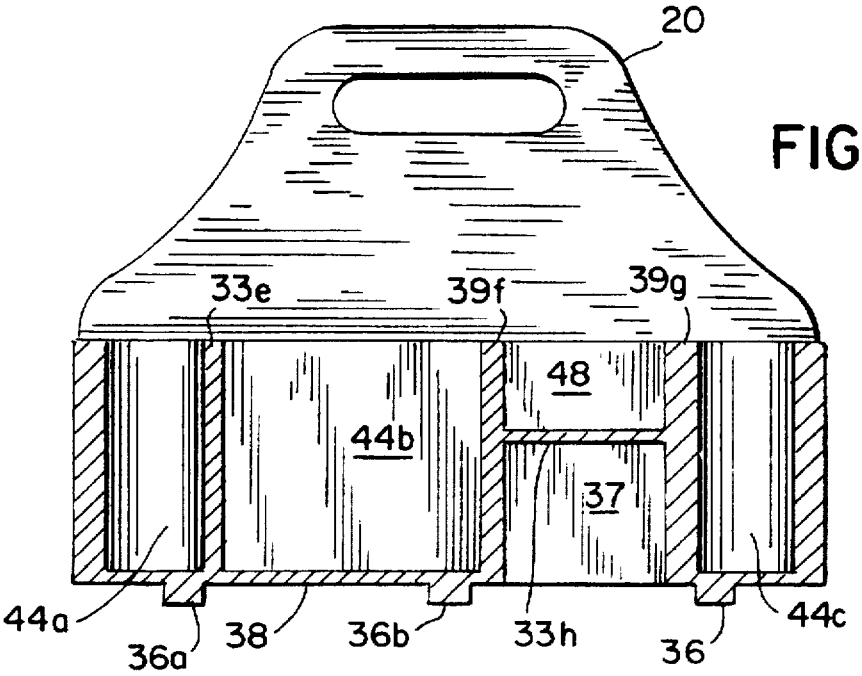
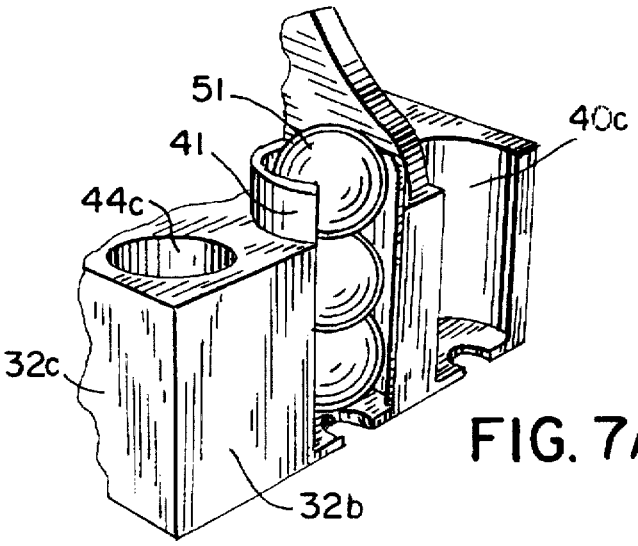
FIG. 7A

CARRIER FOR HOCKEY ARTICLES AND EQUIPMENT

FIELD OF THE INVENTION

The present invention relates to a carrier for articles and equipment used by a hockey team. In particular, the present invention relates a relatively compact carrier for hockey articles and equipment that allows convenient transport and easy access by the coach or staff.

BACKGROUND OF THE INVENTION

The coach or staff of a hockey team must carry various articles and equipment, such as water bottles and pucks (for ice hockey) or balls (for roller, street or field hockey, or the like), to and from practices and games. Typically, water bottles are carried in a "six-pack" open (plastic or wire) frame carrier, well-known to organized team sports. Hockey pucks (or balls) are typically carried in a separate bag. Other articles and equipment that the coach or staff needs to have during practices or games, such as a training board with eraser and markers, a skate sharpener, a helmet repair kit (with tools), tape roll and a whistle, also have to be carried along by some other means. These other means do not typically allow convenient transport and easy access to such articles and equipment during the practice or game.

Canadian patent application no. 47,017, filed by Stinson on Jul. 15, 1991 (claiming priority based on U.S. application Ser. No. 554,374, filed on Jul. 19, 1990), which was published on Jan. 20, 1992, shows a caddy consisting primarily of an upright cylindrical portion to carry hockey pucks and a circumferentially mounted set of components to carry containers for liquid refreshment (shown as bottles), with a set of members for carrying rolls of tape. The Stinson caddy, however, is not adapted to carry the wide range of hockey articles and equipment that can be used by a coach or staff.

Accordingly, it would be advantageous to have a carrier that is configured with a plurality of compartments to carry not only water bottles and hockey pucks (or balls) but also a variety of other articles and equipment that are needed or useful during practices and games. It would be advantageous to have a carrier of a relatively compact design that has a sufficient number and arrangement of compartments to allow a coach to carry additional items, such as a first aid kit, other information retaining articles (such as a drawing board or playbook), a tool kit, or the like, in one convenient place, easily accessible to the coach or staff during a practice or game, and easily transported to and from practices or games. It would also be advantageous to have a carrier that is made from a relatively lightweight and durable material and yet is of a relatively sturdy and stable construction.

SUMMARY OF THE INVENTION

The present invention relates to a carrier for hockey articles and equipment including a base having a plurality of compartments configured to carry hockey articles and equipment with at least one of the compartments being adapted to carry a container, at least one of the compartments being adapted to carry hockey pucks, and at least one of the compartments being adapted to carry at least one information retaining article, and a handle coupled to the base.

BRIEF DESCRIPTION OF THE DRAWINGS

FIG. 5 is a sectional side view of the carrier;

FIG. 6 is a sectional side view of the carrier;

FIG. 7A is a cutaway perspective view of the end of the carrier in an alternative embodiment adapted to carry balls;

DETAILED DESCRIPTION OF THE PREFERRED EMBODIMENTS

Figure 1:
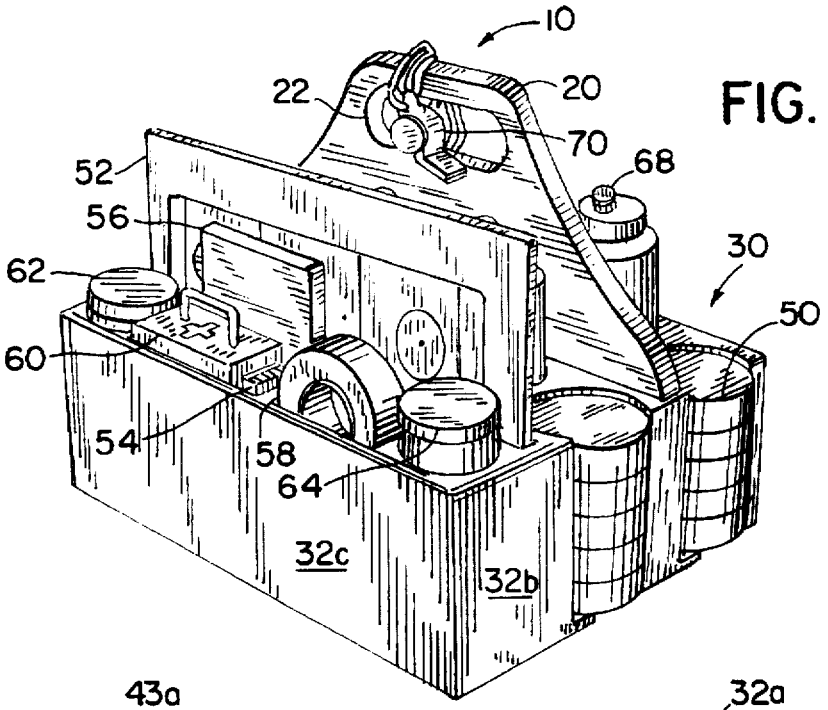
FIG. 1 is a perspective view of a carrier according to a preferred embodiment showing various hockey articles and equipment in a stowed or stored arrangement within corresponding compartments.

Referring to FIG. 1, a preferred embodiment of a carrier 10 for hockey articles and equipment is shown in a perspective view with the various articles and equipment stowed or stored (i.e., carried) within corresponding compartments. Carrier 10 includes a substantially upright handle 20 with a substantially horizontal slot 22 by which carrier 20 can be lifted and carried. Carrier 10 also includes a base 30, which includes a number of compartments for stowing or storing hockey articles and equipment. Partially visible within the compartments of base 30 of carrier 10 in FIG. 1 are some of the articles and equipment that can be carried, such as hockey pucks 50, an information retaining article shown as a training board 52 (e.g. drawing board or the like), and eraser 54 (for board 52), another information retaining article shown as a booklet 56 (e.g., an address book, play book, rule book, tablet or the like), a roll of tape 58, a first aid kit 60, a kit shown as container 62 (for chalk, markers, pens or the like), and a tool kit 64 (e.g. a helmet repair kit, skate repair kit, other equipment repair kit, or the like). Four of six total fluid containers, shown as plastic bottles (generally reference numeral 68), are also partially visible. A whistle 70 is shown stowed around slot 22 of handle 20.

Figure 2:
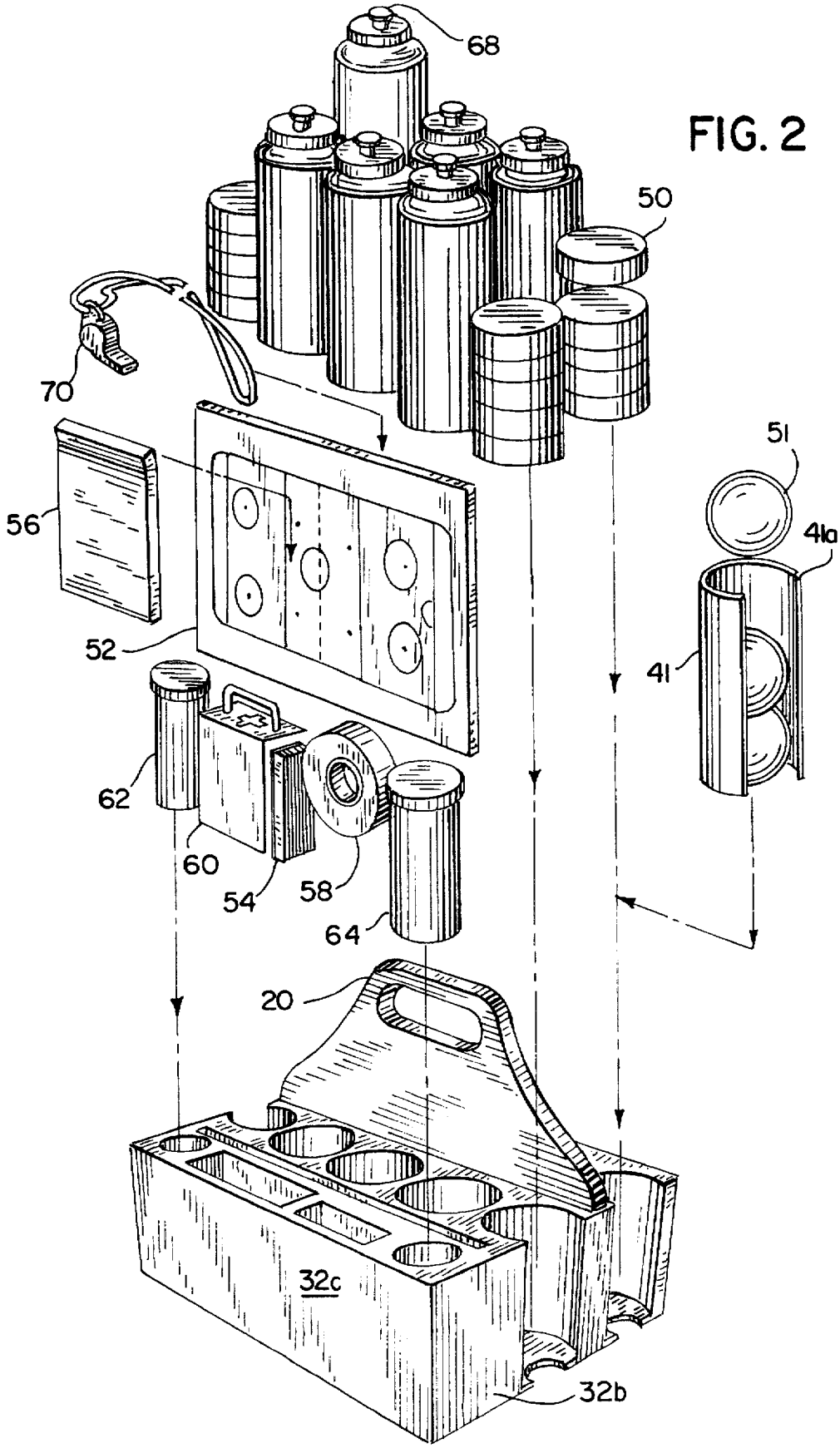
FIG. 2 is an exploded perspective view of the carrier showing the compartments in relation to the associated articles and equipment that are stowed or stored therein.

As shown in FIGS. 1 and 2, carrier 10 is configured to stand in a stable and upright position, with the various articles and items at least partially exposed for ease of access, yet also at least partially received and retained (i.e., stowed or stored) securely within their respective compartments (which will be described in more detail with reference to FIG. 3). For example, pucks 50 are stowed in stacks in four compartments (40*a* through 40*d*) at opposed ends of base 30 (and when stowed extend partially beyond the perimeter of the ends of base 30), to provide ease of removal and insertion.

In the preferred embodiment, as shown in the FIGURES, base 30 is of an orthogonal construction (having an outer shell) and includes vertical four side panels (or sidewalls) (shown as 32*a* through 32*d*). The side panels (32*a* through 32*d*) combine to provide structural stability for carrier 10 (as do the inner vertical members, the top surface 34 and the bottom member, described below with reference to FIGS. 5 and 6). Side panels 32*a* and 32*c* of base 30 (or any other exposed surface of carrier 10) can be configured to display a message of some kind, such as a team name, sponsor, advertisement or the like. In alternative embodiments, the base can be of any other shape that suitably facilitates the carrying of articles and equipment. For example, the carrier can be of an open frame (plastic or wire or the like) construction (i.e., with no outer shell), or of a combined construction with a partial shell (i.e., one or more sidewalls). Alternatively, the side panels (or sidewalls) can be angled or curved. The carrier can also be formed in a substantially round or oval shape, or any other shape that can be adapted to include a suitable arrangement of compartments. In any preferred embodiment, the carrier is configured to stand upright in a stable position.

FIG. 2 shows carrier 10 with the articles and equipment removed from their respective compartments, in an exploded view. Visible in FIG. 2 are handle 20 and base 30, along with several of the compartments (40 through 48). Also shown are the articles and equipment that can be carried and that were partially visible in FIG. 1: hockey pucks 50 (some are not visible); board 52 (and eraser 54); booklet 56; tape roll 58; first aid kit 60; kit 62; tool kit 64; bottles 68 (some are only partially visible); and whistle 70. As is apparent from the FIGURES, in the preferred embodiment, some of the compartments of carrier 10 have a substantially circular cross-section (e.g. 40*a* through 40*d*, 42*a* through 42*f*, and 44*a* and 44*b*) and others have a rectangular cross-section (e.g. 44*b*, 46 and 48).

It is important to note that in alternative embodiments (not shown), carrier 10 can be configured to carry a wide variety of other articles and equipment for the hockey team, such as other tools (e.g. screwdrivers and pliers or the like), a stopwatch, a skate sharpener (or like tools for adjusting roller hockey skates), a sharpening stone, and a hockey stick gauge. (One "miscellaneous" compartment or more can also be included in base 30 for any other items not listed herein.) Such configurations can be made possible by simply varying the sizes and shapes (cross-sections and orientations) of the various compartments in the carrier or of the base itself.

Also shown in FIG. 2 is a sleeve 41 (shown typically) which can be used in an alternative embodiment of carrier 10 when balls 51 (for roller hockey, street hockey, field hockey, or the like) are to be carried instead of pucks. Sleeve 41 (shown in compartment 40*d*) fits within each of compartments (40*a* through 40*d*) that ordinarily would hold pucks, as shown more closely in FIG. 7A. (In an alternative embodiment that is not shown, base 51 could be configured with compartments suitable to carry a sufficient quantity of balls without the need for sleeves 41 (i.e., depending upon the shape of base 30). Sleeve 41 has an opening (substantially vertical) 41*a* allowing access to the balls.

Figure 3:
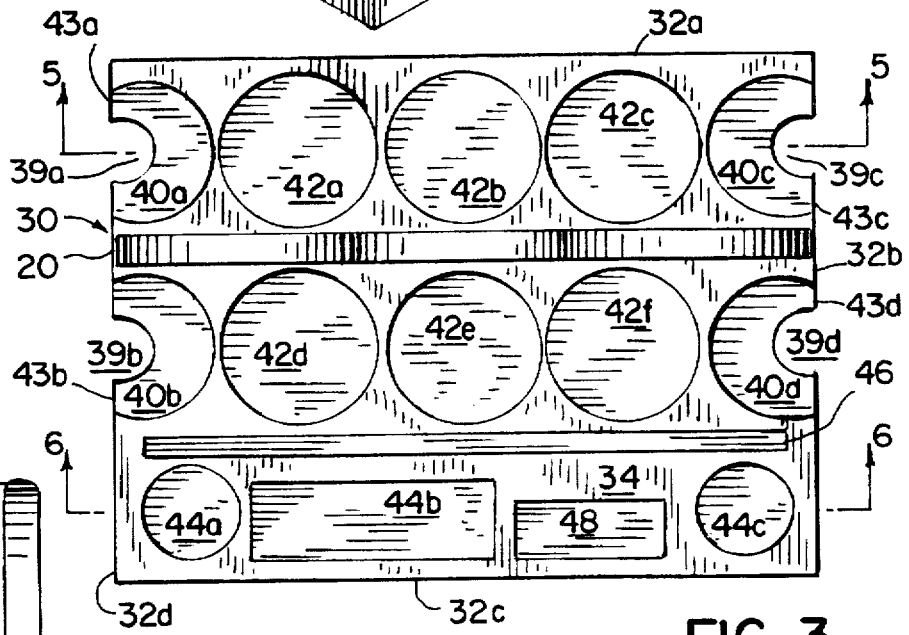
FIG. 3 is a top view of the carrier showing the compartments within which the associated articles and equipment are stowed or stored.

In FIG. 3, a top view of carrier 10, compartments 40*a* through 40*d*, 42*a* through 42*f*, 44*a* through 44*c*, 46 and 48 for receiving and retaining articles and equipment are shown in cross-section. As shown in FIG. 3 (and also in FIGS. 1 and 2), the compartments extend from a substantially horizontal top surface 34 into base 30 in a substantially vertical (i.e. downward) direction with respect to the orientation of base 30. (In alternative embodiments (not shown), one or more of the compartments can be oriented with respect to the base at an angle or in a substantially horizontal direction.) In the preferred embodiment, compartments 42*a* through 42*f* are configured to receive and retain containers for fluid refreshments (shown as bottles 68) and in a typical case would be round in cross-sectional shape. In any preferred embodiment, the compartments are sized in cross-section somewhat larger than the articles or equipment that are to be stowed therein, but yet to ensure both a comfortable and secure fit. The compartments are sized in depth to at least partially receive the articles or equipment to an extent that ensures a secure stowing position, but yet to allow convenient access (i.e., removal).

In any embodiment the compartments should (though need not necessarily) have the same basic cross-sectional shape as the particular articles and to be carried therein (see FIG. 2). Compartments 40*a* through 40*d* are specially configured for hockey pucks (or balls in an alternative embodiment); these compartments are substantially circular in cross-section but are exposed at the corresponding side panels (32*b* and 32*d*) of base 30 (through an opening shown as slits 43*a* through 43*d*) allow convenient access to the pucks (or balls); and each of these compartments has an aperture (shown as cut-outs 39*a* through 39*d*). Compartment 48 is intended to be used for both board 52 and booklet 56 (although two or more such compartments could be used for such information retaining articles in an alternative embodiment); compartment 44*a* is intended to be used for container 62 (kit containing chalk, markers, or the like); compartment 44*b* is intended to be used for first aid kit 60 and eraser 54; compartment 48 is intended to be used for tape roll 58; and compartment 44*c* is intended to be used for tool kit 64.

Figure 4:
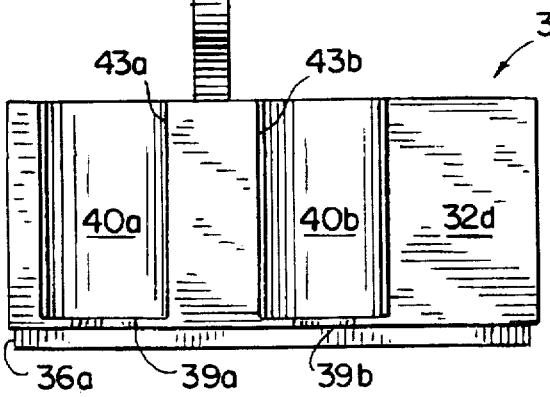
FIG. 4 is an end view of the carrier.

Referring now to FIG. 4, carrier 10 is shown in an end view, which reveals more clearly (in a typical view) side panel 32*d* and the exposed compartments (40*a* and 40*b*) in which pucks (or balls) are retained, with corresponding vertical slits (43*a* through 43*d*) and apertures (39*a* and 39*b*). Handle 20 is visible. Also visible is a support, shown generally as a rib 36*a* (one of three in this embodiment), extending along the bottom edge of base 30. Referring to FIG. 5, a section view of carrier 10, compartments 40*a* and 40*c* and 42*a* through 42*c* are visible in cut-away view, revealing the inner structure of base 30. Also shown in FIG. 5 are each of three support ribs 36*a*, 36*b* and 36*c*, in cross-section view. Inner support members (33*a* through 33*d*) are visible as partitioning the base into compartments. FIG. 6 is another section view of carrier 10 making visible additional aspects of the inner structure of base 30 (which will be described in more detail below), as well as compartments 44 through 44*c* and 48, support ribs 36*a*, 36*b* and 36*c*, and additional inner support members (33*e* through 33*h*).

The inner structure of base 30 includes a substantially horizontal bottom member 38 (establishing a bottom level) and a series of substantially vertical members (only a portion are shown) extending upward therefrom. (In an alternative embodiment not shown, the carrier can be formed essentially without a bottom member as such, with the base and various compartments formed by injection molding or pressed formed or the like as an integral structure.) In the preferred embodiment, the top surface 34 of base 30 establishes a top level from which each of the substantially vertical support members (33*a* through 33*g*, for example) extend downward to the substantially horizontal bottom member, thereby forming and separating (partitioning) the various compartments. In an alternative embodiment (not shown), the carrier can be formed essentially without a top surface, e.g. in an open frame construction.

In any preferred embodiment, the compartments extend into base 30 at any of a variety of depths within a range essentially defined by the distance between the top surface (level) and the bottom member (level) of the base. (Inner partitions such as 33*h* may also adjust the vertical depth; inner partitions such as 33*a* through 33*g* define the cross-section.) As is visible in FIG. 3, the exposed surface area of top surface is significantly less than the surface area of bottom member, given that the compartments each have their openings (visible in cross-section) formed from the top surface. According to the preferred embodiment, all compartments are open-topped (see FIG. 3), although in alternative embodiments (not shown) one or more of the compartments could be provided with a cover of some kind (such as a door or cap or the like). As disclosed, compartments 40*a* through 40*d* for stowing hockey pucks each have an aperture (shown in FIG. 3 as cut-outs 39*a* through 39*d*, respectively) to allow moisture to drain downward out of base 30. Other apertures (not shown) can be formed elsewhere within base 30 (e.g. within one or more other compartments) to facilitate the evaporation or drainage of moisture. (These apertures are not necessary where the carrier is of a substantially open frame construction.)

Support ribs 36*a*, 36*b* and 36*c* not only provide a degree of structural support to carrier 10 but also raise the ground clearance for base 30, which may help serve to keep base 30 and its compartments free of moisture. (In an alternative embodiment, the support can be adapted to provide any desired "footprint" for the carrier or to provide enhanced sturdiness, stability and rigidity.) As shown by example in FIG. 6, base 30 of carrier 10 can be formed with hollow portions (such as shown by 37) between or around the compartments to save weight and material, or to adjust the compartment sizes, provided there is no corresponding loss of structural integrity or of utility.

In a particularly preferred embodiment, the base is constructed of a durable and resilient plastic material of relatively light weight and high strength, yet relatively economical to manufacture. The base can have any number or configuration of compartments, subject to limitations such as the structural integrity of the carrier itself or the efficacy of the compartments to receive and suitably carry the various articles and equipment (as well as ease of access).

Figure 7B:
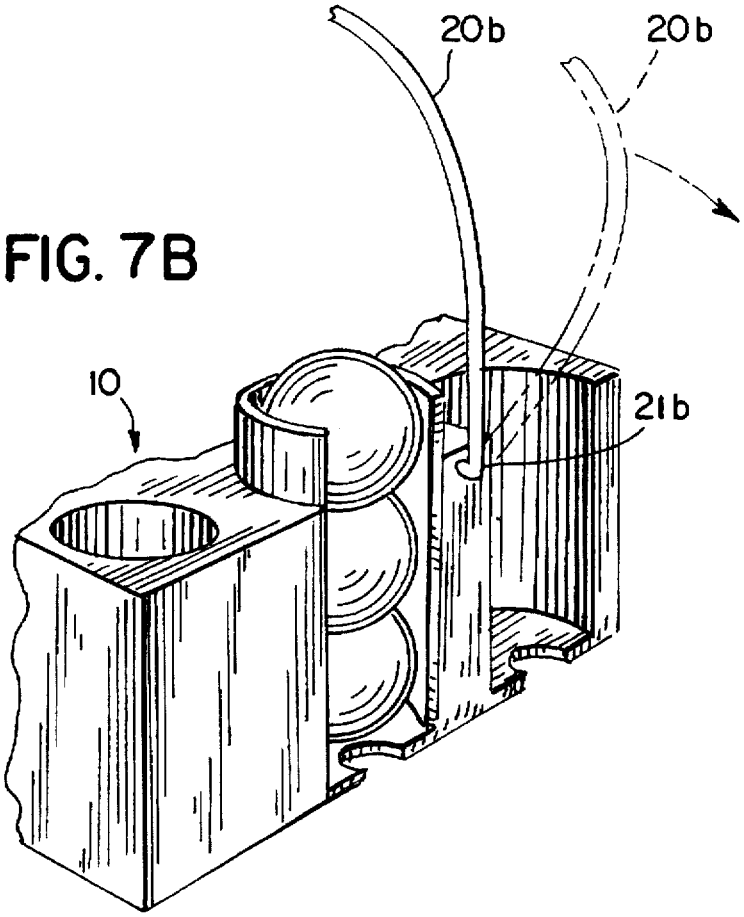
FIG. 7B is a cutaway perspective view of the end of the carrier as shown in FIG. 7A according to an alternative embodiment having a pivotally coupled handle.
Figure 7C:
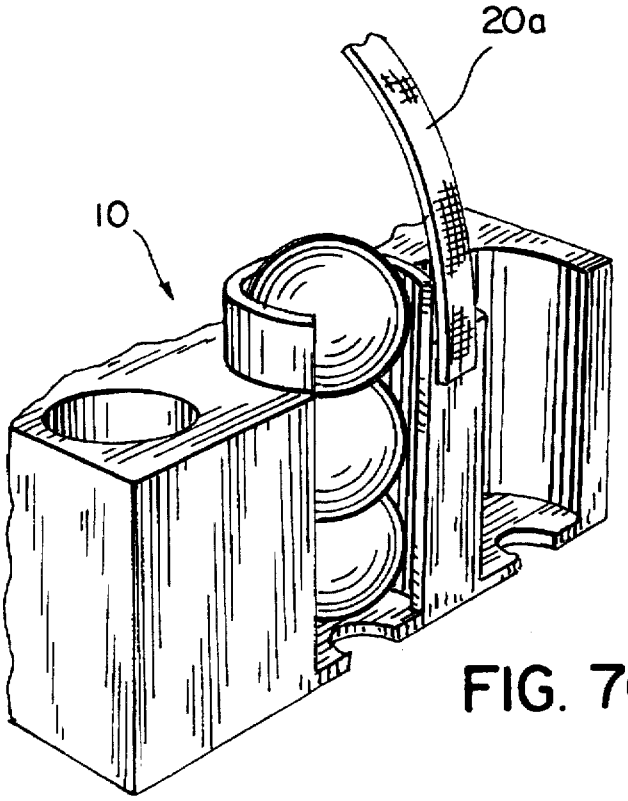
FIG. 7C is a cutaway perspective view of the end of the carrier as shown in FIG. 7A according to an alternative embodiment having a strap handle.

As shown in FIGS. 1, 2 and 6, handle 20 is rigidly fixed to base 30. However, in alternative embodiments, the handle can be secured to the base in a variety of other arrangements, for example, as shown in FIGS. 7B and 7C, known in the art of carriers. For example, in a particularly preferred embodiment, the handle and the base can be formed integrally in a low-cost manufacturing process, e.g., in an unitary injection-molded plastic structure. In other alternative embodiments (not shown), the handle member can be a strap (formed from a fabric or like material of suitable strength) as shown in FIG. 7C, a plastic link (of suitable strength), or a metal wire 20*b* shown in FIG. 7B. In some alternative embodiments, for example, as shown in FIG. 7B, the handle can be pivotally coupled at its ends to the base, in an arrangement (with an end 21*b* of wire 20*b* coupled to base 10) in which the handle is not necessarily retained in a substantially vertical position until used to lift or carry the carrier. In some alternative embodiments (not shown), the handle can be selectively coupled to the base in a manner that permits removal if desired.

In alternative embodiments, the carrier (including the handle member and base) can be manufactured from any of a number of materials of suitable strength and durability, such as wood, composite or matrix materials, a wire frame, any metal material (including sheet metal), and any other type of epoxy, resin or plastic material. The carrier can be formed of a one-piece construction (as described previously) or assembled from a variety of components or sections. In a particularly preferred embodiment, the base is constructed of a durable and resilient plastic material of relatively light weight and high strength, yet relatively economical to manufacture. The base can have any number or configuration of compartments, subject to limitations such as the structural integrity of the carrier itself or the efficacy of the compartments to receive and suitably retain and stow the various articles and equipment (as well as ease of access). The base of the carrier can be of a solid body (as shown) or an open frame (e.g., plastic or metal or the like) construction. In alternative embodiments, the base can be a tray or a bin, with either fixed or adjustable compartments, or a combination thereof. In other alternative embodiments, the base can include a solid outer shell (not unlike shown for example by the combination of top surface 34 with side panels 32*a* through 32*d*); according to a related alternative embodiment, the shell can have integrated cavities (or depressions) that form the various compartments.

In the particularly preferred embodiment shown in the FIGURES, carrier 10 is configured to transport six bottles and twenty pucks, along with one board and various other articles and equipment. In alternative embodiments (not shown), the carrier can be modified in size and shape as necessary to accommodate different (lesser or greater) numbers and different (smaller or larger) sizes and even different shapes of articles and equipment to be transported. For example, the carrier can readily be configured to carry more pucks (or balls) or more containers (bottles), or vice versa. Moreover, the carrier disclosed herein can be configured for use in other sports that involve similar equipment (i.e., refreshment containers, tape rolls, balls, kits, information retaining articles or the like) such as lacrosse, in its present form, with suitable modifications within the scope of the present invention.

Although only a few exemplary embodiments of the present invention have been described in detail above, those skilled in the art will readily appreciate that many modifications are possible in the exemplary embodiments without materially departing from the novel teachings and advantages of this invention. For example, compartments of the carrier can be configured in any of a number of cross-sectional shapes and patterns to carry any of the articles and equipment disclosed herein (or any other articles). Accordingly, all such modifications are intended to be included within the scope of the invention as defined in the following claims. Furthermore, in the claims, each means-plus-function clause is intended to cover the structures described herein as performing the recited function and not only structural equivalents but also equivalent structures.

Other substitutions, modifications, changes and omissions may be made in the design, operating conditions and arrangement of the preferred embodiments without departing from the spirit of the invention as expressed in the appended claims.

I claim:

1. A carrier, which comprises:

a base having a plurality of compartments configured to carry articles and equipment at least one of the compartments being adapted to carry a container, at least one of the compartments being adapted to carry hockey pucks or balls, the at least one compartment adapted to carry hockey pucks or balls including at least one substantially vertical opening providing access to the hockey pucks or balls; and a handle coupled to the base;

wherein at least one of the plurality of compartments has at least one aperture adapted to allow fluid drainage from the base.

2. The carrier of claim 1 wherein the plurality of compartments includes at least one compartment having a substantially circular cross-section and at least one compartment having a substantially rectangular cross-section.

3. The carrier of claim 1 wherein the base comprises a substantially rigid structure.

4. The carrier of claim 1 wherein the base comprises an integral assembly.

5. The carrier of claim 1 wherein the base comprises a substantially open frame.

6. The carrier of claim 1 wherein the base includes a substantially solid shell.

7. The carrier of claim 1 wherein at least one of the plurality of compartments is oriented in a substantially vertical direction.

8. The carrier of claim 7 wherein at least one of the plurality of compartments is substantially open-topped.

9. The carrier of claim 1 wherein the handle and the base are an integral assembly.

10. The carrier of claim 1 wherein the handle has a first end and a second end and the base has a first coupling and a second coupling, the first end being pivotally coupled to the base at the first coupling and the second end being pivotally coupled to the base at the second coupling.

11. The carrier of claim 1 wherein the handle is a strap.

12. A carrier, which comprises:

a base having a plurality of compartments configured to carry hockey articles and equipment, at least one of the compartments being adapted to carry a container, at least one of the compartments being adapted to carry hockey pucks; and means coupled to the base for carrying the carrier;

wherein at least one of the plurality of compartments is oriented in a substantially vertical direction at least one of the plurality of compartments is substantially open-topped, and the least one compartment adapted to carry hockey pucks includes at least one substantially vertical open-topped providing access to the hockey pucks.

13. The carrier of claim 12 wherein the plurality of compartments includes at least one compartment having a substantially circular cross-section and at least one compartment having a substantially rectangular cross-section.

14. The carrier of claim 12 wherein the means for carrying the carrier is a handle.

15. The carrier of claim 12 wherein the base includes an outer shell.

16. The carrier of claim 12 wherein the plurality of compartments includes at least one compartment adapted to carry at least one information retaining article.

17. The carrier of claim 12 wherein the plurality of compartments includes at least one compartment adapted to carry at least one kit.

18. A carrier, which comprises:

a base having a plurality of compartments configured to carry hockey articles and equipment, at least one of the compartments being adapted to carry a container, at least one of the compartments being adapted to carry hockey pucks, and at least one of the compartments being adapted to carry at least one information retaining article; and a handle coupled to the base;

wherein at least one of the plurality of compartments is oriented in a substantially vertical direction, at least one of the plurality of compartments is substantially open-topped, and the at least one compartment adapted to carry hockey pucks includes at least one substantially vertical opening providing access to the hockey pucks.

19. A structure for carrying articles and equipment, the structure comprising a base having a plurality of compartments, at least one of the compartments being adapted to carry a container, and at least one of the compartments being adapted to carry hockey pucks or balls, wherein at least one of the plurality of compartments is substantially open-topped, and the at least one compartment adapted to carry the hockey pucks or balls includes at least one substantially vertical opening providing access to the hockey pucks or balls, wherein the at least one compartment adapted to carry hockey pucks or balls includes a bottom having a cutout at least partially continuous with the at least one substantially vertical opening providing access to the hockey pucks or balls.

20. The structure of claim 19 where the at least one compartment adapted to carry the hockey pucks or balls is configured to carry the objects in a substantially vertical stacked orientation.

21. The structure of claim 19 wherein the base is made of a substantially rigid material and has a generally orthogonal shape.

22. A carrier, which comprises:

a base having a plurality of compartments configured to carry articles and equipment at least one of the compartments being adapted to carry a container, at least one of the compartments being adapted to carry hockey pucks or balls, the at least one compartment adapted to carry hockey pucks or balls including at least one substantially vertical opening providing access to the hockey pucks or balls; and a handle coupled to the base;

wherein the handle has a first end and a second end and the base has a first coupling and a second coupling, the first end of the handle being pivotally coupled to the base at the first coupling and the second end of the handle being pivotally coupled to the base at the second coupling.

* * * * *